United States Patent [19]

Ksiensyk et al.

[11] 3,941,253

[45] Mar. 2, 1976

[54] RAIL VEHICLE COUPLER WITH CABLE COUPLING

[75] Inventors: Klaus Ksiensyk, Remscheid-Lennep; Barun Kumar Chatterjee, Remscheid, both of Germany

[73] Assignee: Bergische Stahl-Industrie, Remscheid, Germany

[22] Filed: Mar. 26, 1975

[21] Appl. No.: 562,236

[30] Foreign Application Priority Data

Mar. 26, 1974 Germany ..... 2414384

[52] U.S. Cl. ..... 213/1.3; 248/53

[51] Int. Cl.[2] ..... B61G 5/06

[58] Field of Search ..... 213/1.3, 76; 280/422; 339/10; 285/63; 248/53, 67

[56] References Cited

UNITED STATES PATENTS

| | | | |
|---|---|---|---|
| 1,353,557 | 9/1920 | Averill et al. | 213/1.3 |
| 3,552,580 | 1/1971 | Cope | 213/1.3 |

FOREIGN PATENTS OR APPLICATIONS

| | | | |
|---|---|---|---|
| 1,020,361 | 12/1957 | Germany | 213/1.3 |
| 1,024,270 | 3/1953 | France | 213/1.3 |

*Primary Examiner*—Drayton E. Hoffman
*Assistant Examiner*—John P. Shannon
*Attorney, Agent, or Firm*—Walter Becker

[57] ABSTRACT

A vehicle coupler in which at least one cable coupling box is mounted on the coupling head for cooperation with a like coupling box on another coupling head to effect coupling together of conduits, such as air and electric conduits, when the vehicle is coupled to another vehicle. The coupling head has guide rods extending in coupling direction on which the coupling box is slidably mounted. The connectors which connect the coupling box to the rods include elastic inserts permitting movement of the coupling box in the lateral direction of the guide rods to provide for alignment of the coupling box with the coupling box with which it cooperates.

6 Claims, 4 Drawing Figures

RAIL VEHICLE COUPLER WITH CABLE COUPLING

The present invention relates to a rail vehicle coupling system with cable coupling for the control lines while the cable box is displaceable in longitudinal direction on the coupling head and is adapted to be actuated automatically or manually while being provided with means for self centering the coupled cable coupling means.

Generally by means of central coupling means or central buffer couplings, especially the rigid couplings, i.e., couplings which in coupled condition form a rigid unit from pivot point to pivot point of the joints, the cable couplings are automatically connected to each other. This operation is effected automatically and interconnectes the electric control lines of the two coupled vehicles. Cable couplings have become known which are fixedly connected to the mechanical couplings and are displaceably arranged on the mechanical coupling for displacement parallel to the longitudinal coupling axis or by means of a connecting point are mounted on the coupling head for pivoting forwardly. Due to the low number of contacts and in view of the thus relatively great contact distances, it was normally not possible to do without a self concentration of the cable boxes. Since, however, with increasing mechanization of the railway operation, the railway companies demand an ever greater number of contacts to be coupled on a minimum space, it is necessary while considering admissible wear of the centering surfaces and of the mechanical latching elements to provide a self-centering of the cable couplings under all circumstances.

With a rigid connection between the electrical and the mechanical coupling, the contact surfaces of the electrical contacts in the coupling plane describe a path which is proportional to the wear of the self-centering surfaces of the mechanical coupling head and to the distance of the contacts from the coupling axis in the coupling plane. Such construction, however, is not feasible, and it is necessary to provide the cable with a self-centering mechanism and to mount said cable couplings elastically opposite the mechanical coupling head.

It is, therefore, an object of the present invention to provide a mounting for the cable couplings on the mechanical coupling head which within a certain region independently of the mechanical coupling will permit a coupling of the cable boxes to each other so that the wear of the mechanical coupling will not harmfully affect the cable coupling.

In addition thereto, it is another object of this invention so to provide an arrangement as set forth in the preceding paragraph that the above mentioned linkage connection and mounting of the cable box on the mechanical coupling will be simple in construction so that not only the functions but also the repair can be carried out in a simple manner.

These and other objects and advantages of the invention will appear more clearly from the following specification in connection with the accompanying drawings, in which.

The relative vehicle clutch according to the present invention with a cable coupling for the control lines, according to the present invention is characterized primarily in that for a cable box there are provided at least two guiding bars extending in longitudinal direction and arranged on the coupling head and/or coupling box and is furthermore characterized in that the eyes for the guiding bars are through a joint of elastic material respectively connected on the other part.

Advantageously, the eye should be provided in a bearing housing which at the rearward end has an opening into which there is clamped a web through the intervention of elastic inserts for instance of rubber, while there is provided a screw, bolt, or the like, which extends through the bearing housing and the web. The advantage of this device according to the present invention is seen primarily in that one or more cable boxes may be arranged for displacement along the longitudinal axis of the coupling head while the mounting on the guiding bars is elastic so that the two cable boxes to be coupled to each other can, provided with a self-centering means, precisely and properly be coupled to each other. This coupling operation can take place completely independently of the coupling operation of the mechanical coupling head. In particular, the face that in this connection the cable couplings can still precisely couple regardless of whether or not the mechanical coupling head has worn more or less, represents a considerable advantage because cable boxes must generally be exchanged earlier than the pertaining mechanical clutches. Due to the elastic joints, a relative movement between the cable boxes and the mechanical coupling head is made possible which movement remains also after the two elements have been coupled to the corresponding couplings of the counter-vehicle so that also after coupling the mechanical clutch and after engaging the cable clutch the two couplings can move independently of each other within certain limits.

The fact is important that no relative movements of the two couplings to be coupled to each other will be possible with regard to each other which otherwise could bring about short circuits which jeopardize the train safety system.

Figure 1:
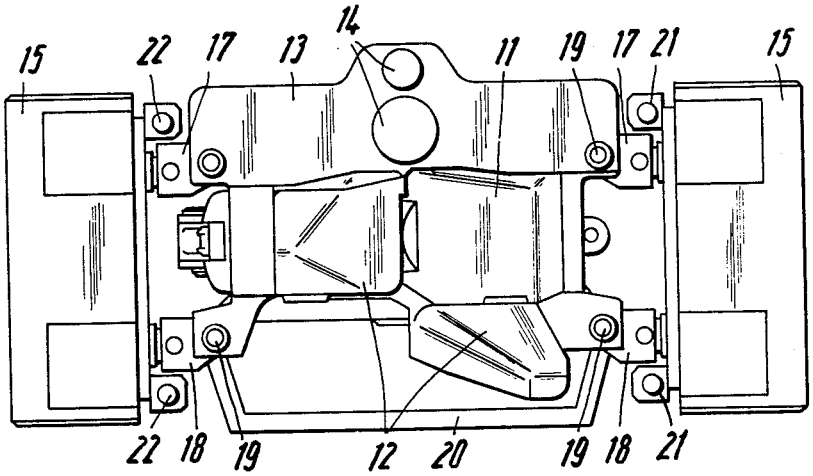
FIG. 1 is a front view of a mechanical coupling head with two cable couplings arranged laterally on the head.
Figure 2:
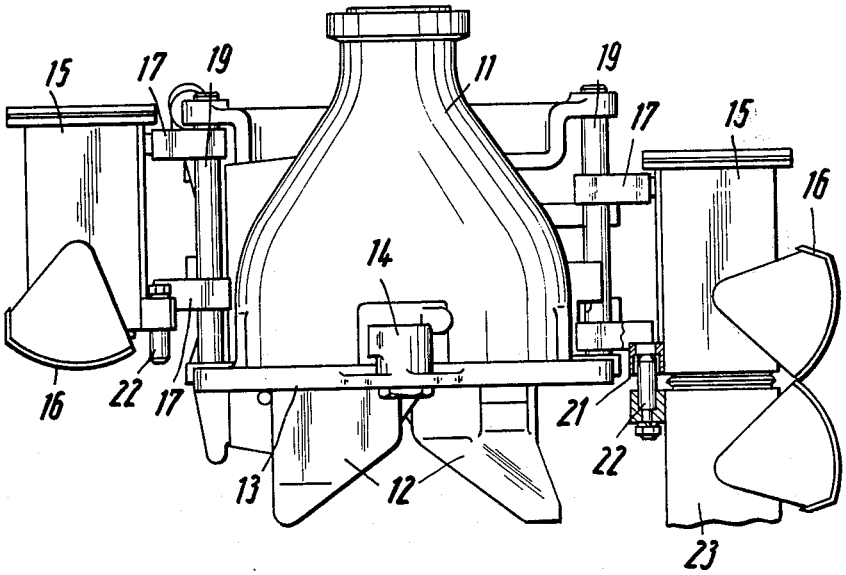
FIG. 2 is a view of the coupling head of FIG. 1 as seen from above, said coupling head being provided with a cable coupling coupled on one side.
Figure 4:
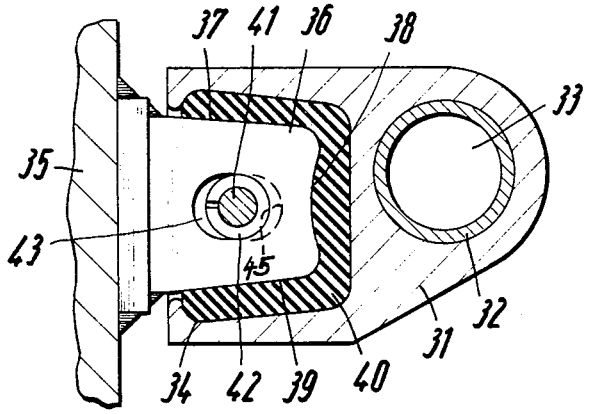
FIG. 4 is a section taken along the line IV—IV of FIG. 3.

Referring now to the drawings in detail, FIGS. 1 and 2 shown the mechanical coupling head 11 arranged in a manner known per se on a non-illustrated pull rod. The mechanical coupling head 11 has its front side adjacent the guiding horns 12 provided with a push surface 13 in which likewise by way of example air couplings 14 are arranged. On both sides of this head 11 there are respectively arranged cable boxes 15 extending in vertical direction, which are closed toward the front by a pivotable coupling cover 16 so that the non-visible contacts are protected against soiling when the ball head is not used.

Each cable box 15 is by means of two upper joints 17 and two lower joints 18 respectively linked to one guiding rod 19 each for displacement in the longitudinal direction of the coupling. The front lower joints 18 are interconnected by an actuating rod 20.

Mounted on each cable box 15 at the top and at the bottom there are link elements 21 known per se for a self-centering operation. These elements consist on one side of an eye and on the other side of a mandrel 22 fitting into said eye.

Figure 3:
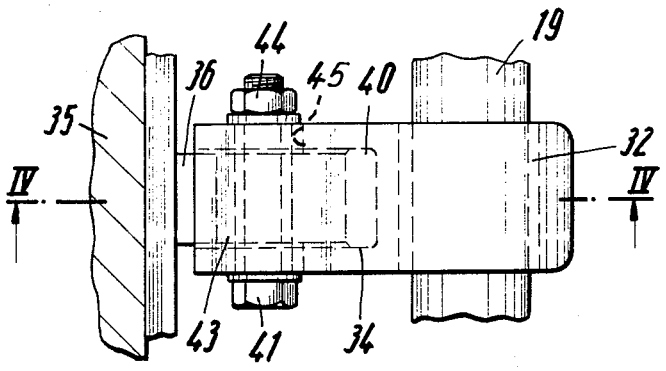
FIG. 3 is a top view of a joint for use in connection with the present invention.

According to FIG. 3, each joint 17 and 18 comprises a bearing housing 31 which includes an eye 33 for the guiding rod 19, said eye being lined with a bushing 32. At the other end of the bearing housing 31 there is provided an opening 34 into which extends the web 36 which is fixedly connected to the cable box 35, 15. The opening 34 is only slightly wider than the web 36 but between the surfaces 37, 38 and 39 of the web 36 which surfaces are parallel to the guiding rod 19, and the corresponding surfaces in the opening 34 of the bearing housing 31 there is clamped in a strip 40 of an elastic material, for instance an elastomer. Bearing housing 31 and web 36 are held together by a screw 41 which is located in a clamping sleeve 42. The screw 41 penetrates the two walls of the opening 34 of the bearing housing and also the web 36. The bore in web 36 is designed as an oblong hole 43, whereas the bores in the side walls are designed as oblong holes 45 extending in opposite direction whereby a movement between the cable boxes 35 and the bearing housing 31 or the guiding bar 19 located in the eye 33 of said box 35 will be made possible, said movement being dampened by the elastic strip 40. The clamping sleeve 42 is held by screw 41 which is screwed fast by nut 44.

For actuating the cable coupling with an uncoupled mechanical coupling 11, according to FIG. 2, a cable box 15 is displaced forwardly parallel to the longitudinal axis of the coupling, until the contacts are located in the abutting plane therebetween. During the displacement of the cable box 15, the four bearing housings 17, 18, are with their eyes 33 displaced on the guiding bars 19. In view of the slight fitting in the width of the web 36 in the opening 34, hardly a relative movement of the bearing housing 17, 18 is possible relative to the web 36 in the displacement direction so that the eyes 33 cannot edge or clamp on the guiding bar 19. However, due to the elastic mounting of the webs 36 in the opening 34 of the bearing housing, the cable box 15 is able to be displaced in vertical direction and more specifically about a pivot point which is located in the center of the guiding bar 19. This displacement together with the pivot point formed by screw 41 forms a parallel construction for the cable boxes 15 on the guiding bars 19. Due to this displacement possibility of the cable boxes 15 in the vertical direction and due to the oblong hole 43 also in the horizontal plane, the centering mandrel 22 of the cable coupling 23 of the vehicle to be coupled can engage the bore of the centering opening 21. In this connection, the two cable boxes 15 and 23 are able due to their movability to adjust themselves precisely perpendicularly with regard to each other, also when the mechanical coupling heads 11 are not precisely standing one in front of the other, because they are for instance worn or because another defect is present. The cable boxes always have so high a movability in the necessary direction that they can be centered precisely with regard to each other by means of the self-centering arrangement 21, 22. In a manner known per se, when the coupling boxes move together, the covers 16 have been opened which effect in the present instance is brought about automatically by the specific shape. It is important that the cable boxes in the direction of the longitudinal axis of the coupling shaft or in the direction of the guiding rod 19 have no or only one slight movability in the joints 17 and 18 so that the contact pressure can under all circumstances be maintained.

It is, of course, possible to effect considerable changes in the frame of the present invention. This may be advantageous particularly when other mechanical coupling heads or other cable boxes are employed. Thus, it is possible without any difficulties to provide the guiding rods on the cable boxes and to provide the joints on the mechanical coupling head. This is advantageous particularly when other devices are connected to the cable boxes. Furthermore, it is not necessary under all circumstances to provide an oblong hole in the web 36. This hole may also have a more or less round shape in connection with which it is important that the diameter of this bore 43 is greater than the outer diameter of the clamping sleeve 42. Of course, also the screw 41 may be replaced by a mandrel pressed into a side of the bearing housing 31. On the other hand, it is also possible to provide the bores for the screw or the clamping sleeve 42 greater only in the side walls of the housing 31 or to provide said bores as an oblong hole and to this end firmly to anchor this part in web 36 for instance by pressing. On the other hand, the cable boxes may, of course, be provided at any other place for instance above or below the mechanical coupling while when greater dimension of the cable box are involved, also three guiding rods 19 may by provided.

It is, of course, to be understood that the present invention is, by no means, limited to the specific showing in the drawings, but also comprises any modifications within the scope of the appended claims.

What is claimed is:

1. A rail vehicle coupling including a coupling head and cable coupling means for control conduits, a pair of guide rods on the coupling head extending longitudinally thereon in coupling direction, said cable coupling means comprising a coupling box slidably supported on said rods and adapted for cooperation with a like coupling box on another coupling head during a coupling operation, said coupling box having members thereon formed with eyes slidably engaging said rods, each said member comprising first and second parts and resilient means interposed between said parts for resiliently supporting the respective eye on said coupling box.

2. A coupling according to claim 1 in which one of said parts is formed with a socket and the other of said parts has a web portion disposed in said socket, elastic insert means fitted into said socket and embracing said web portion, and a bolt extending through said one part in the range of the socket therein and also through said web portion and connecting said parts together.

3. A coupling according to claim 2 in which holes are formed in said one part and in said web portion to receive said bolt, each hole being elongated in the direction of insertion of the web portion into the socket.

4. A coupling according to claim 2 in which said web portion is generally rectangular in lateral cross section, said socket having walls generally parallel to and spaced from the opposite side surfaces and the end surface of said web portion, said elastic insert means being clamped between the said side and end surfaces of said web portion and the opposed walls of said socket.

5. A coupling according to claim 4 in which the other surfaces of said web portion which are perpendicular to the said side surfaces thereof are parallel and perpendicular to the axis of the respective rod, the walls of said socket opposed to said other surfaces of said web portion being parallel therewith and closely adjacent thereto.

6. A coupling according to claim 5 in which said one part has holes therein and said web portion has a hole therein and a bolt extending through said holes and parallel to the respective rod, said one part having the eye therein which slidably engages the rod and the holes in said one part being elongated in the direction toward the rod, the other said part being connected to the coupling box and the hole in the web portion being elongated in the direction toward said box.

* * * * *